US008424229B2

(12) United States Patent
De Beer

(10) Patent No.: US 8,424,229 B2
(45) Date of Patent: Apr. 23, 2013

(54) DISPLAY ITEM SLIDE

(75) Inventor: Eric R. De Beer, Gauteng Province (ZA)

(73) Assignee: Press Products (Proprietary)

( * ) Notice: Subject to any disclaimer, the term of this patent is extended or adjusted under 35 U.S.C. 154(b) by 1113 days.

(21) Appl. No.: 11/939,080

(22) Filed: Nov. 13, 2007

(65) Prior Publication Data

US 2008/0116341 A1 May 22, 2008

(30) Foreign Application Priority Data

Nov. 16, 2006 (ZA) ..... 2006/09534

(51) Int. Cl.
*G09D 3/00* (2006.01)

(52) U.S. Cl.
USPC ..... 40/107; 40/372; 40/282; 24/561; 248/309.1

(58) Field of Classification Search ..... 40/107, 40/372, 382; 24/561, 67.11; 248/309.1
See application file for complete search history.

(56) References Cited

U.S. PATENT DOCUMENTS 1,906,024 A * 4/1933 Todd ..... 40/107
2,042,912 A * 6/1936 Stuebing, Jr. ..... 29/33.5
6,988,330 B2 * 1/2006 Gavronsky ..... 40/107
D522,053 S * 5/2006 Gavronsky ..... D19/20
D522,574 S * 6/2006 Gavronsky ..... D19/20
7,251,875 B2 * 8/2007 Blumberg et al. ..... 29/509

* cited by examiner

*Primary Examiner* — Kimberly Wood
(74) *Attorney, Agent, or Firm* — Wood, Herron & Evans, LLP

(57) ABSTRACT

A slide for attaching to a display item such as a calendar, a poster, document, banner, wall hanging, or workpiece, has a longitudinal channel with a first end and second end and a longitudinal bend extending from the first end to the second end, a first bend portion and a second bend portion joined by the longitudinal bend, the first and second bend portions each having respective interior confronting surfaces adapted to receive an edge of the display item therebetween and respective exterior surfaces, a pair of bulges projecting from the first bend portion, a first bulge being close to the first end and a second bulge being close to the second end; and a hanger generally centrally fast with the second bend portion. The slides are paired in sets, the bulges of a first slide being spaced a different extent from its edges to those of the second set, so that the bulges of the paired slides do not coincide if one is nested in the other. The bulges may be symmetrically or asymmetrically arranged. A number of the sets provide a magazine.

6 Claims, 3 Drawing Sheets

DISPLAY ITEM SLIDE

This invention relates to slides for display items, in particular calendars.

According to the invention there is provided a slide for attaching to a display item comprising:

a longitudinal channel with a first end and second end and a longitudinal bend extending from the first end to the second end;

a first bend portion and a second bend portion joined by the longitudinal bend, the first and second bend portions each having respective interior confronting surfaces adapted to receive an edge of the display item there between and respective exterior surfaces;

a pair of bulges projecting from the first bend portion, a first bulge being close to the first end and a second bulge being close to the second end; and a hanger generally centrally fast with the second bend portion.

Further according to the invention there is provided a set of slides for attaching to a display item comprising a first and a second slide as described above, in which the bulges of the first slide are spaced a different extent from its ends to the bulges of the second slide.

It will be appreciated that the bulges of the first and second slides of the set will not coincide if one is nested in the other.

Conveniently both bulges of the first slide may be closer to the respective ends thereof than the second slide. In this arrangement the bulges of each slide may be symmetrically positioned. Instead, the bulge at the first end of the first slide may be closer to its associated end than the corresponding bulge of the second slide and the bulge at the second end of the first slide may be further from its associated end than the corresponding bulge of the second slide. In this arrangement the bulges of each slide will be asymmetrically positioned.

The bulges may preferably project from the exterior surface of the first bend portion.

The hanger of each slide may be secured to the interior surface of its second bend portion.

The second bend portion may be wider than the first bend portion

The slides may be of metal and the exterior surfaces of the first and second bend portions may be coated.

The channel may be generally V-shaped.

The bulges may extend from a lateral edge of the first bend portion inwardly and may end short of the longitudinal bend.

The hanger may be of plastic and it may be secured to the first bend portion by a fastener coupling the hanger to the channel. The bulges may then extend from the exterior surface of the first portion substantially the same extent as the fastener extends from the interior surface of the second bend portion.

The invention extends further to a magazine of slides, comprising a number of the sets described above nested in one another, such that there is a series of slides having bulges that alternate.

It will thus be appreciated that the bulges of one slide do not coincide with the bulges of the next slide in the series such that the bulges of one slide do not nest in the bulges of the next slide in the series.

The invention is now described by way of an example with reference to the accompanying drawings, in which.

Figure 1:
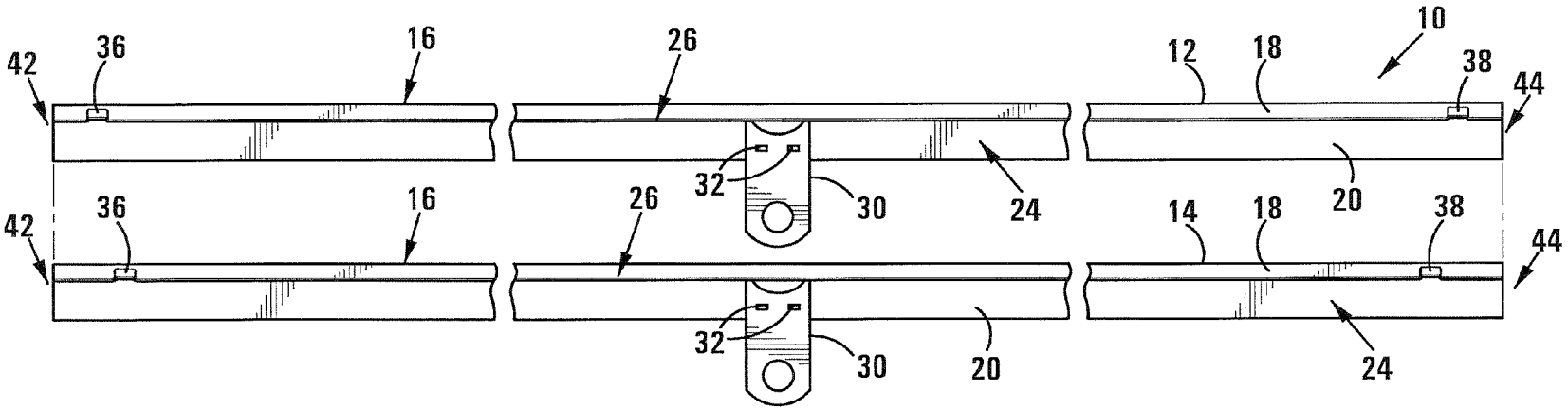
FIG. 1 shows schematically a set of slides for a calendar, in accordance with the invention.

A set of calendar slides in accordance with the invention is shown generally in FIG. 1, designated generally by reference numeral 10. The set 10 comprises a first slide 12 and a second slide 14, which are generally similar except for the position of bulges, as is explained below. It will be understood by those skilled in the art that, while the present invention is described as a calendar slide, the slides 12, 14 may be used to bind and hang or display any other desired display item, such as a poster, document, banner, wall hanging, or workpiece.

The calendar slides 12, 14 are typically made from a strip of sheet metal, although other substances with similar characteristics could be used. The typical sheet metal used is a cold rolled mild steel plate with a thickness of approximately 0.21 mm; however, other types and/or sizes of metal could also be used. The sheet metal is bent to form a longitudinal bend 16, which creates a generally V-shaped channel from the sheet metal strip. The longitudinal bend 16 in the sheet metal channel separates a first bend portion or leg 18 and a wider second bend portion or leg 20. According to one embodiment, the width of the first bend portion 18 is approximately 3.8 mm and the width of the second wider bend portion 20 is approximately 16.8 mm. These relative dimensions, while typical for usual application, could be proportionally or non-proportionally altered for special applications, such as an unusually large or heavy calendar or other display item. Similarly, while the slides 12, 14 will normally have different size bend portions or legs 18, 20, slides with generally the same size bend portions or legs 18, 20 may be used. The angular separation □ of the first bend portion 18 and the wider second bend portion 20 is approximately 38 degrees, although a greater or lesser degree of initial, angular separation could be used for particular applications. Each bend portion 18, 20 has respective interior surfaces 22, 24 and respective exterior surfaces 26, 28. The exterior surfaces 26, 28 of the respective bend portions 18, 20 are normally coated, e.g., with paint, to prevent oxidization and/or to achieve a desired aesthetic effect.

A hanger, tab, or eyelet 30 is attached to the longitudinal center of the interior surface 24 of the wider second bend portion 20 by a metal burr, rivet, glue, or other suitable fastener 32. The hanger 30 could, if desired, be attached to other parts of the slides 12, 14, for example, the exterior surface 28 of the wider second bend portion 20.

Figure 3:
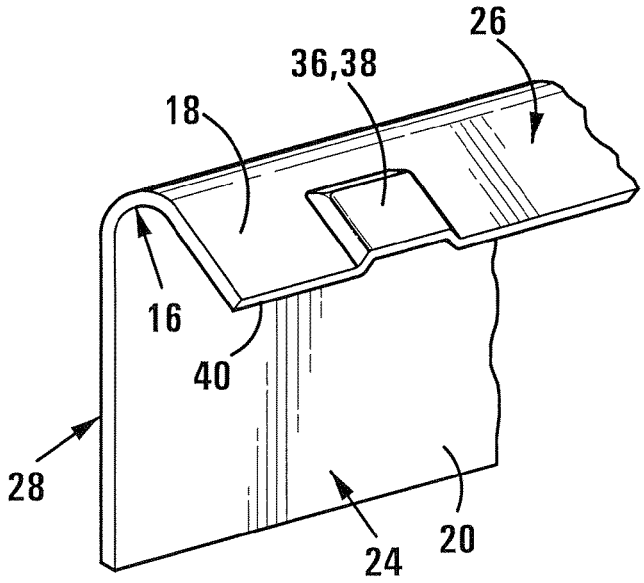
FIG. 3 shows a detail of an end of the first slide shown in FIG. 1.

Further, a pair of spaced convex bulges 36, 38 rise up, generally to a height of approximately 0.5 mm, from the exterior surface 26 of the shorter first bend portion 18, away from the second bend portion 20. The height of the convex bulges 36, 38 is substantially the same as the thickness of the hanger 30 and/or the thickness of the burr, rivet, or other fastener 32. These convex bulges 36, 38 are generally at the lateral edges 40 of the first bend portion 18 and extend inwardly to end short of the longitudinal bend 16. As seen in FIG. 3, the bulges 36, 38 are angular and have a generally planar outer face. They are also positioned relatively near to, and at a distance generally equal from, the respective longitudinal ends 42, 44 of the slides 12, 14. It will be noted that the bulges 36, 38 of the first slide 12 are closer to the ends 42, 44 than the bulges 36, 38 of the second slide 14. Thus, it will be appreciated that the bulges 36, 38 of the slide 12 will not coincide with the bulges 36, 38 of the slide 14 when the slide 14 nests in the slide 12.

Figure 4:
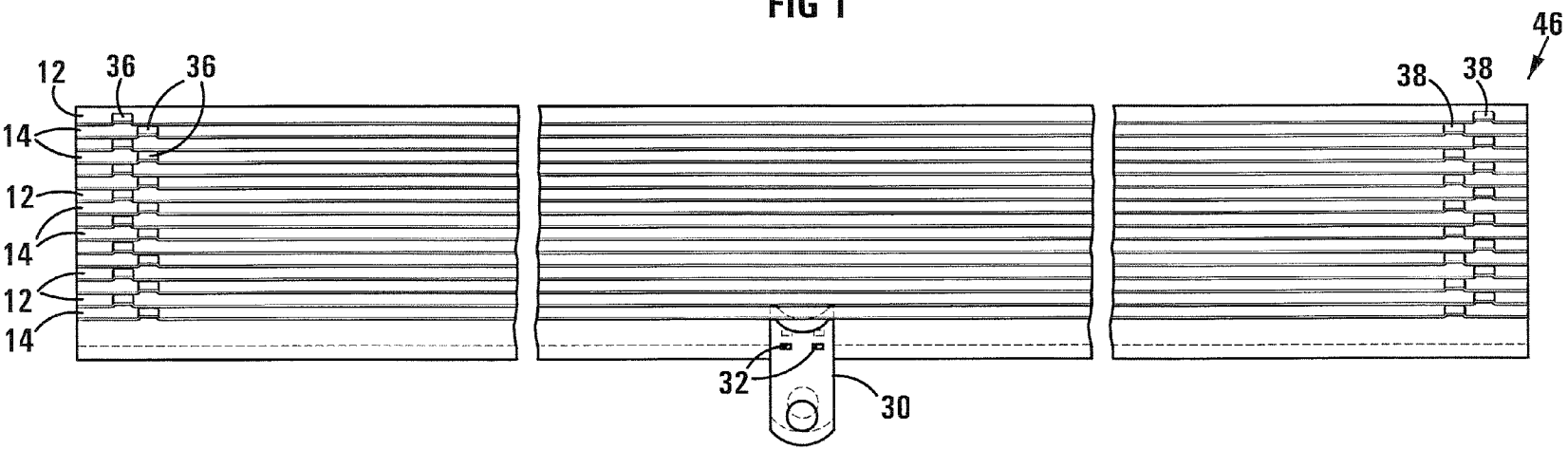
FIG. 4 shows a series of the slides for use in a magazine.
Figure 2:
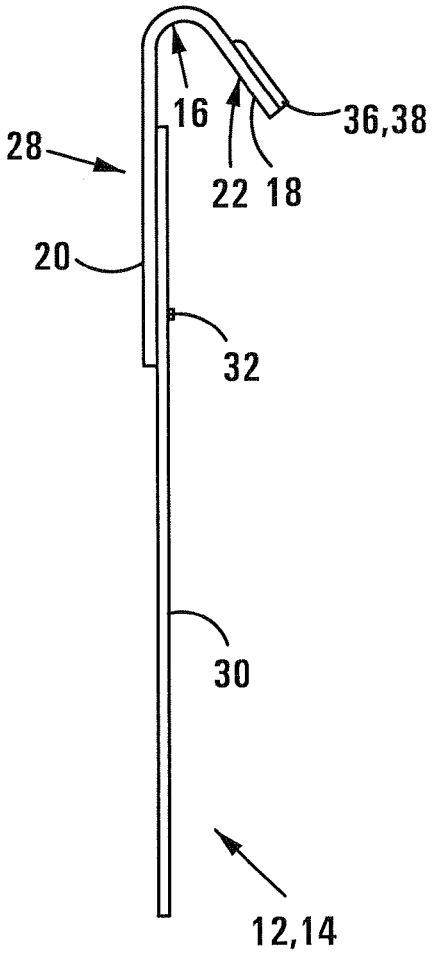
FIG. 2 shows a schematic side view of the slides.

Referring now to FIG. 4, a series 46 of the slides 12, 14 is shown, in a nested array. As is shown, the slides 12, 14 alternate. It will be appreciated that the bulges 36, 38 cause adjacent slides to be slightly separated thereby to facilitate extraction thereof, in use, from a magazine. It will further be appreciated that, because the bulges 36, 38 have a similar height to that of the fastener 30, the series 46 will be substantially linear and will not adopt a curved configuration.

Figure 5:
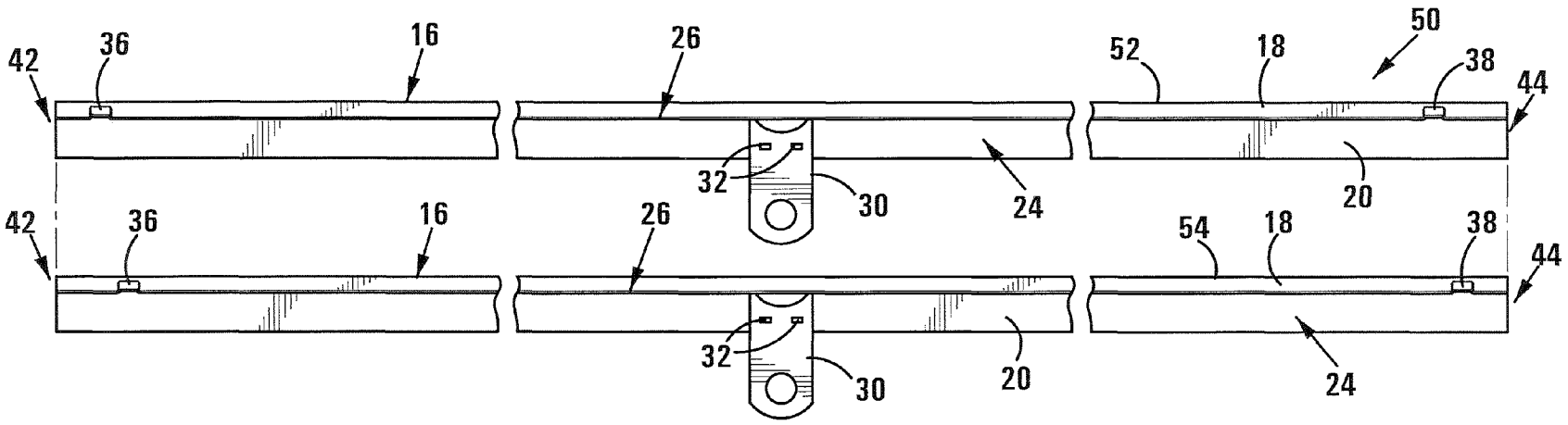
FIG. 5 shows schematically a set of slides for a calendar, in accordance with another embodiment of the invention.

Referring now to FIG. 5, a set of calendar slides in accordance with another embodiment of the invention is shown. One difference between FIGS. 1 and 5 is that the bulges 36, 38 in the embodiment of FIG. 1 are symmetrical relative to the hanger 30, with the bulges of the slide 12 being closer to the ends than the bulges of the slide 14. Whereas in FIG. 5 the bulges 36, 38 are asymmetrical relative to the hanger 30, with the bulge 36 of the slide 52 being closer to its associated end than the bulge 36 of the slide 54 and the bulge 38 of the slide 52 is further from its end than the bulge 38 of the slide 54.

The invention claimed is:

1. A slide for attaching to a display item comprising:

a longitudinal channel with a first end and a second end and a longitudinal bend extending from the first end to the second end;

a first bend portion and a second bend portion joined by the longitudinal bend, the first and second bend portions each having respective interior confronting surfaces adapted to receive an edge of the display item therebetween and respective exterior surfaces;

a pair of bulges projecting from the first bend portion, a first bulge being close to the first end and a second bulge being close to the second end, each of the bulges having a generally planar outer face, wherein each of the bulges is located at an edge of the first bend portion and the edge of the first bend portion is generally linear with the exception of non-linear portions at each of the bulges; and a hanger generally centrally fast with the second bend portion.

2. A magazine of slides in which each slide is for attaching to a display item, the magazine comprising:

a first slide nested together with a second slide in an aligned manner, each slide further comprising:

(a) a longitudinal channel with a first end and a second end and a longitudinal bend extending from the first end to the second end;

(b) a first bend portion and a second bend portion joined by the longitudinal bend, the first and second bend portions each having respective interior confronting surfaces adapted to receive an edge of the display item therebetween and respective exterior surfaces;

(c) a pair of bulges projecting from the first bend portion, a first bulge being proximate to the first end and a second bulge being proximate to the second end; and (d) a hanger generally centrally fast with the second bend portion;

wherein the bulges of the first slide do not coincide with the bulges of the second slide and the bulges of the first slide are spaced different distances from the respective ends than the bulges of the second slide relative to their associated ends.

3. A magazine of slides as claimed in claim 2 in which each of the bulges of the first slide is closer to its respective end than each of the bulges of the second slide relative to its respective end.

4. A magazine of slides as claimed in claim 3 wherein the first bulge proximate to the first end of the first slide is closer to its associated end than the first bulge of the second slide relative to its associated end and the second bulge proximate to the second end of the first slide is further from its associated end than the second bulge of the second slide relative to its associated end.

5. A magazine of slides as claimed in claim 4 further comprising a plurality of the first slides and a plurality of the second slides with the first and second slides alternating with one another in the magazine such that the bulges of each slide do not coincide with the bulges of an adjacent slide in the magazine.

6. A magazine of slides as claimed in claim 2 wherein each of the bulges has a generally planar outer face and is located at an edge of the respective first bend portion and the edge of each first bend portion is generally linear, with the exception of non-linear portions at each of the bulges.

* * * * *